US006779460B2

(12) United States Patent
Hickey

(10) Patent No.: US 6,779,460 B2
(45) **Date of Patent: *Aug. 24, 2004**

(54) SUPPORT VESSEL FOR SELF-BURYING MINES

(75) Inventor: Christopher Daniel Dowling Hickey, Haywards Heath (GB)

(73) Assignee: Lawborough International Limited, W Sussex (GB)

( * ) Notice: Subject to any disclaimer, the term of this patent is extended or adjusted under 35 U.S.C. 154(b) by 0 days.

This patent is subject to a terminal disclaimer.

(21) Appl. No.: 10/001,502

(22) Filed: Nov. 1, 2001

(65) Prior Publication Data

US 2002/0088365 A1 Jul. 11, 2002

(30) Foreign Application Priority Data

Nov. 3, 2000 (GB) ..... 0026913

(51) Int. Cl.[7] ..... F42B 22/10; F41F 3/00; F41F 3/04

(52) U.S. Cl. ..... 102/411; 102/412; 102/401; 102/406; 89/1.81; 89/1.809

(58) Field of Search ..... 102/410–413, 102/412, 406, 401; 89/1.81, 1.809; 175/6–10

(56) References Cited

U.S. PATENT DOCUMENTS 1,515,195 A * 11/1924 Elia ..... 102/413
2,789,503 A * 4/1957 Glennon et al. ..... 102/412
2,820,971 A * 1/1958 Welsh et al. ..... 102/411
3,084,627 A * 4/1963 Holm ..... 102/411
3,291,095 A * 12/1966 Nickerson, Jr.
3,749,933 A * 7/1973 Davidson ..... 102/413
3,842,770 A * 10/1974 Hedbawny et al. ..... 102/402
4,063,602 A * 12/1977 Howell et al. ..... 175/7
4,314,363 A * 2/1982 Thigpen et al.
4,395,952 A 8/1983 Hickey
4,586,421 A 5/1986 Hickey
4,586,452 A * 5/1986 Lapetina et al.
4,770,255 A * 9/1988 Barthelemy et al. ..... 175/6
4,909,327 A * 3/1990 Roche
4,972,907 A * 11/1990 Sellars, Jr.
5,184,328 A * 2/1993 Dumestre, III
5,689,086 A * 11/1997 Stottlemyer ..... 102/411
5,733,066 A * 3/1998 Myers
6,044,745 A 4/2000 Hickey
6,443,240 B1 * 9/2002 Scott ..... 175/7

FOREIGN PATENT DOCUMENTS

GB 2 222 805 B 3/1990

* cited by examiner

*Primary Examiner*—Michael J. Carone
*Assistant Examiner*—Lulit Semunegus
(74) *Attorney, Agent, or Firm*—Armstrong Teasdale LLP

(57) ABSTRACT

The disclosure relates to a supply vessel for transporting a plurality of payload carrying containers having powered self-burying mechanism to enable the containers to bury themselves in the seabed when released from the vessel. Each container is connected to the vessel by an umbilical including a power supply from the vessel to the container for powering the self-burying mechanism.

2 Claims, 3 Drawing Sheets

SUPPORT VESSEL FOR SELF-BURYING MINES

CROSS REFERENCE TO RELATED APPLICATION

This application claims the benefit of United Kingdom Patent Application No. 0026913.4, filed Nov. 3, 2000.

BACKGROUND TO THE INVENTION

1. Field of the Invention

This invention relates to support vessels for self-burying a bed mine.

2. Description of the Prior Art

European Patent Publication No. 0110554 discloses an underwater weapon system comprising an elongate outer container which is buried or partially buried in the seabed in an upright position using self-burying means which are at the bottom end of the container and which preferably comprise both pump means for removing sand or silt and rotary material displacing means, e.g. an auger for boring a hole in the seabed or rotary stirring means. The weapon is a self-propelled device with guidance means and is housed within an inner container which is telescopically arranged within the outer container.

U.S. Pat. No. 6,044,745 discloses an enclosure for installation on the seabed comprising an outer cylindrical container one of which is more buoyant than the other so that the container lies in a vertical orientation when disposed in the sea and auger devices at the other end of the container for activating sand/silt/shingle on the seabed to create a cavity below the container into which the container can self-bury. The container has a payload compartment within the container for holding weaponry, listening, identification recording and/or communications equipment. The container wall is formed with a plurality of separate passages extending spirally from inlets at the lower end of the container upwardly to outlets at the top of the container through which activated sand/silt shingle and water generated at the lower end of the container can flow upwardly and freely as the container self-buries in the seabed.

European Patent Publication No. 1,092,937 discloses a further self-burying seabed device comprising an enclosure for installation in the seabed comprising an elongate container for holding a payload such as a weapon and/or a communication system. The container has a plurality of passages extending lengthwise of the container and impeller means are provided at the lower and of the container for drawing water through at least one of said passages from the other end of the container to form a slurry with the material of the seabed during burying of the device in the seabed during burying of the device in the seabed and for discharging through at least one other of said passages to said other end of the container for discharge into the surrounding water to create a hole in the sea-bed into which the device sinks.

This invention provides support vessels for self-burying sea-bed mines.

More specfically, this invention provides a supply vessel for transporting a plurality of payload carrying containers having powered self burying mechanism to enable the containers to bury themselves in the seabed when released from the vessel by each container being connected to the vessel by an umbilical including a power supply from the vessel to the container for powering the self burying mechanism.

For example, each of the containers may have an electric motor powered burying mechanism and the umbilical carries electric power from the vessel to the container for the self burying operation.

Preferably the umbilical connecting the vessel to a container has a remote release devices between the umbilical and container for releasing the umbilical connection to the container when the container has buried itself in the seabed.

In any of the above arrangements the vessel may be a submarine or surface vessel having an internal housing for storing containers to be deposited on the seabed or external carrier devices for carrying the containers until they are released.

BRIEF DESCRIPTION OF THE DRAWINGS

The following is a description of some specific embodiments of the invention, reference being made to the accompanying drawings in which.

DESCRIPTION OF THE PREFERRED EMBODIMENTS

Figure 1:
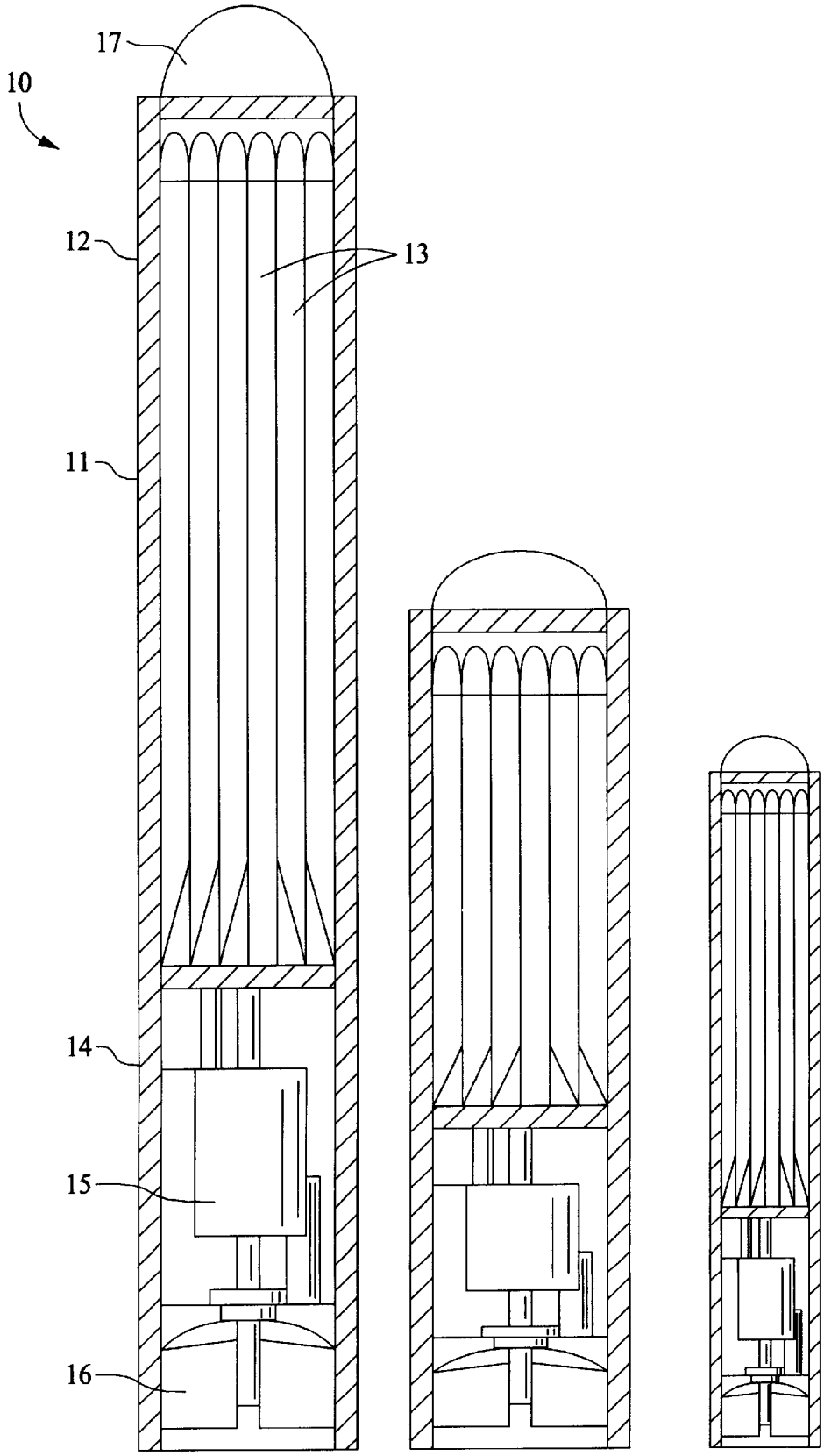
FIG. 1 illustrates a seabed mine having a self-burying mechanism.

Referring firstly to FIG. 1 of the drawings, there is shown an example of a self-burying container or mine indicated generally at 10 of the type described and illustrated in our European patent publication Nos. 0357441 and 1,092,937. The container has an outer container 11 having an upper portion containing a supply of weapons such as torpedoes 13 and a lower portion 14 containing a motor driven impeller 15, 16 for excavating material at the seabed to create a hole into which the container can settle and thereby bury itself.

The container has a nose 17 at its upper end containing communications systems for detecting the presence of surface or underwater vessel and determining whether it is friend or foe in accordance with the characteristic sound transmission from the propulsion units. The communications system may also include systems for deploying to the surface to transmit signals regarding vessel movements detected by the system. The nose also contains a remote release connection for linking the mine by an umbilical cord to a vessel from which the mine has been deployed for powering the container and in particular the motorised impeller 15,16 for the self-burying operation of the mine.

Figure 2:
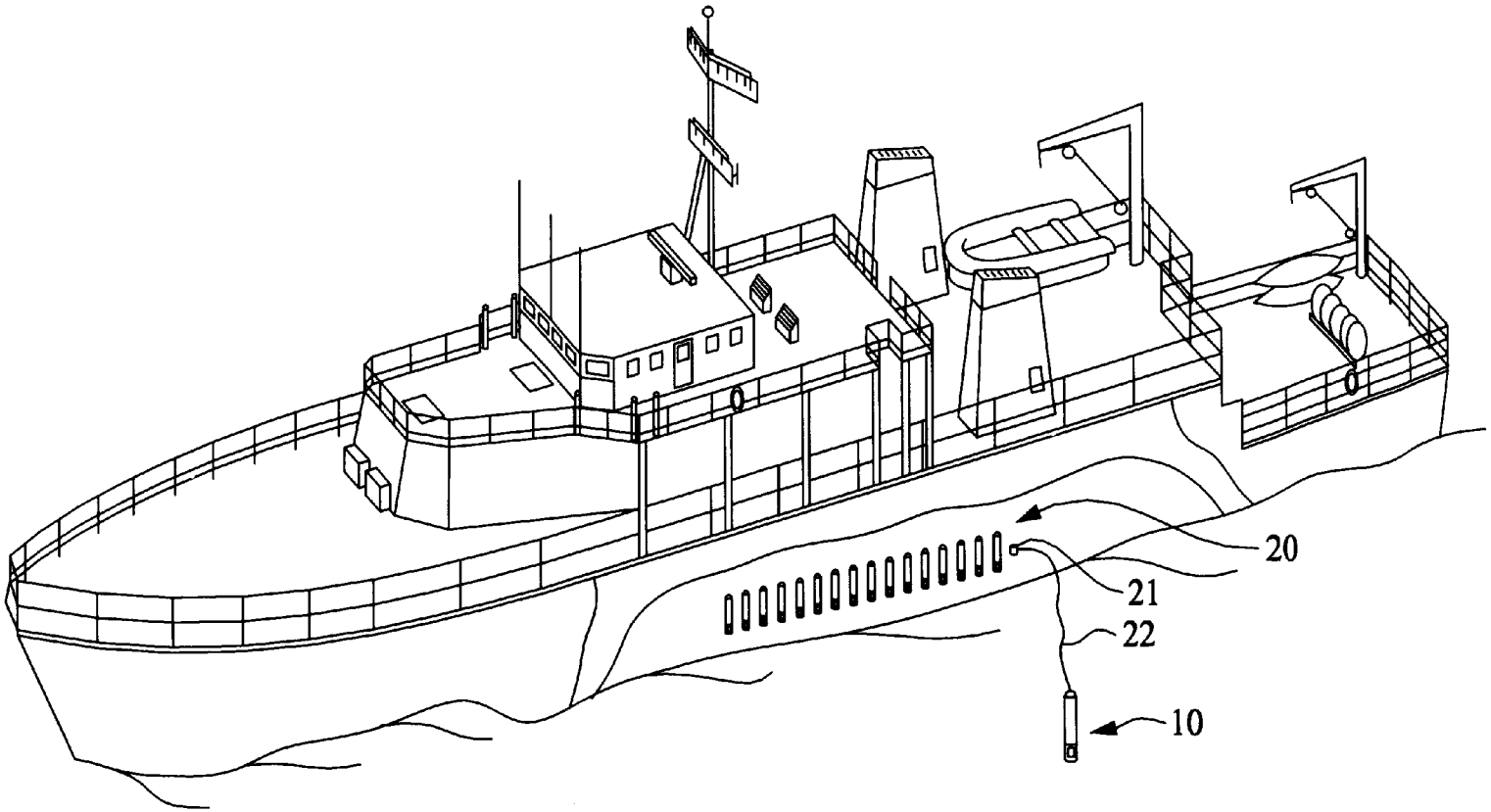
FIG. 2 shows a surface vessel having a hold containing a supply of self-burying mines and an umbilical system for powering a mine whilst being deployed into the seabed.

Reference is now made to FIG. 2 of the drawings which shows a typical surface vessel used for carrying and deploying such containers having a specially fitted hold containing a supply of containers which is indicated generally at 20. The vessel has a terminal unit 21 from which an umbilical cord 22 containing the power supply extends, the umbilical being connected to the socket on the nose 17 of a container to be deployed. The umbilical provides power to the motorised impeller of the mine from the vessels power supply, in particular for the self-burying operation for which a considerable power consumption may be required particularly in the case of hard or rock like material at the seabed.

Figure 3:
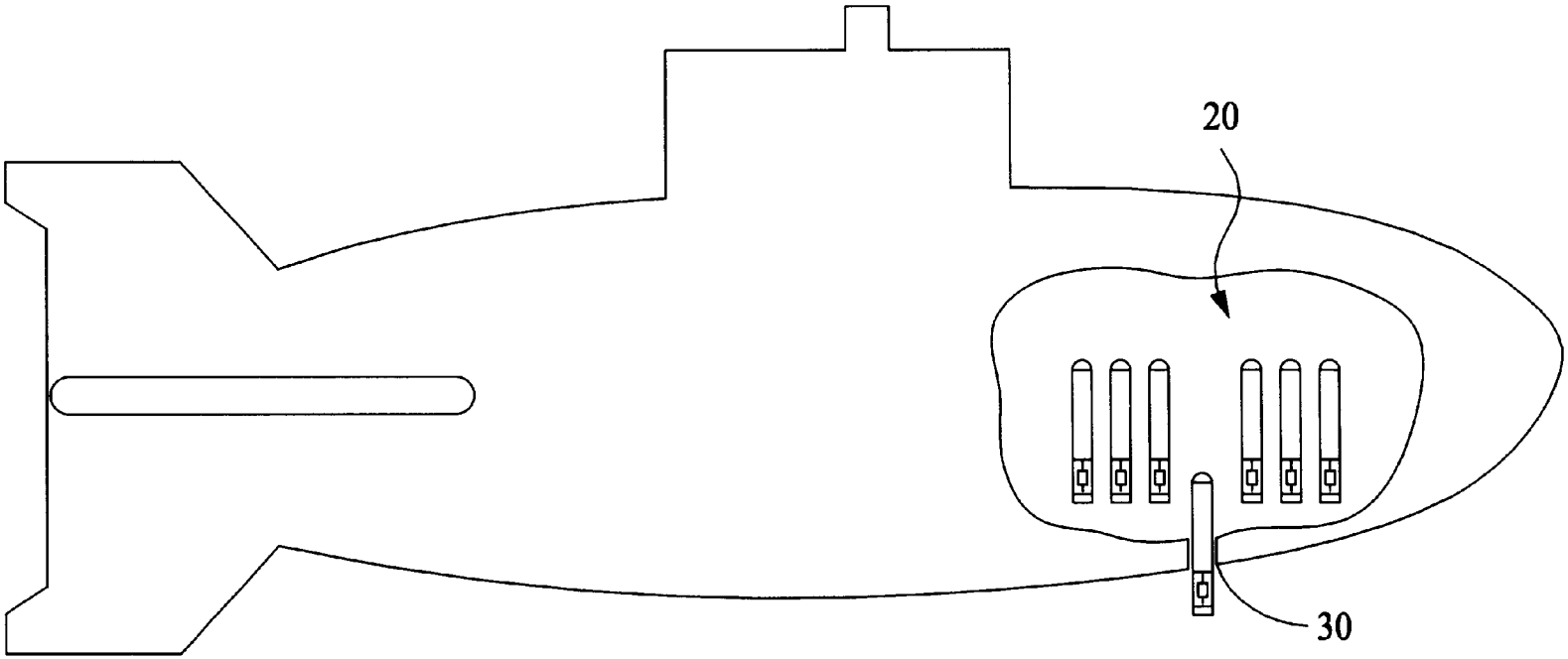
FIG. 3 shows a submarine similarly equipped to the surface vessel of FIG. 2.

FIG. 3 of the drawings shows a submarine having a hold containing self-burying containers of the form shown in FIG. 1 and again an umbilical cord system is provided for connecting the submarine power supply to a mine to be deployed. In this case the submarine has a bottom hatch indicated at 30 from which containers are released for deployment on the seabed.

It will be appreciated that many modifications may be made to the above described embodiments without departing from the scope of the invention. For example submarines having external anchorage/fitment points on which de-mountable panniers may be mounted to carry mines/containers.

In this way any submarine could be used for the task, thereby giving greater flexibility in the operational role, rather than being restricted to only being able to use those submarines which are dedicated to this particular task. Additionally the same concept could be used for surface vessels, if fitted out of sight well below the water line.

What is claimed is:

1. A supply vessel adapted to transport a plurality of payload carrying elongate containers each having a powered self-burying mechanism to enable the container to bury itself in the seabed when released from the vessel, the vessel having a power supply and an umbilical extending from the vessel for supplying power to a container remote from the vessel, the umbilical having a distal end provided with a remotely releasable connector for connection to a container and each container having, at one end, powered means to bury the container in the seabed and, at an opposite end, a connection for receiving the connector at the distal end of the umbilical, whereby the vessel supplies power via the umbilical to the container for powering the self-burying mechanism of the container, the vessel having means to release the umbilical from the container when the container has self-buried in the seabed.

2. A vessel as claimed in claim 1, wherein the vessel is a submarine or surface vessel having internal housings for storing containers to be deposited on the seabed or external carrier devices for carrying the containers until they are released.

* * * * *